US010513664B1

(12) United States Patent
Koseoglu

(10) Patent No.: US 10,513,664 B1
(45) Date of Patent: Dec. 24, 2019

(54) INTEGRATED AROMATIC SEPARATION PROCESS WITH SELECTIVE HYDROCRACKING AND STEAM PYROLYSIS PROCESSES

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/222,402

(22) Filed: Dec. 17, 2018

(51) Int. Cl.
*C10G 69/14* (2006.01)
*C10G 65/18* (2006.01)

(52) U.S. Cl.
CPC ..... *C10G 69/14* (2013.01); *C10G 65/18* (2013.01); *C10G 2300/1081* (2013.01); *C10G 2300/1088* (2013.01); *C10G 2300/1096* (2013.01)

(58) Field of Classification Search
None
See application file for complete search history.

(56) References Cited

U.S. PATENT DOCUMENTS 2,627,495 A * 2/1953 Lanning ..... C10G 21/04 208/80
3,023,158 A * 2/1962 Watkins ..... C10G 69/00 208/89
3,159,567 A * 12/1964 Young ..... C10G 47/00 208/87
3,394,199 A * 7/1968 Eng ..... C10G 65/06 585/256
3,507,777 A * 4/1970 Hemminger ..... C10G 21/003 208/86
6,113,775 A * 9/2000 Christolini ..... C10G 65/18 208/78
9,145,521 B2 * 9/2015 Koseoglu ..... C10G 21/16
9,359,566 B2 6/2016 Koseoglu
2005/0258073 A1 * 11/2005 Oballa ..... C10G 9/00 208/67
2008/0194900 A1 * 8/2008 Bhirud ..... C10G 9/00 585/648
2010/0087686 A1 * 4/2010 Fong ..... C07C 1/26 568/795
2012/0067776 A1 3/2012 Diehl et al.
2012/0149958 A1 * 6/2012 Ellrich ..... C07C 2/864 585/321

(Continued)

FOREIGN PATENT DOCUMENTS

EP 0485077 B1 2/1995
KR 1489546 B1 2/2015
WO 2016162887 A1 10/2016

OTHER PUBLICATIONS

Karimzadeh, R, et al., Effect of Solvent Dearomatization and Operating Conditions in Steam Pyrolysis of a Heavy Feedstock, Energy Fuels, 24, 1899-1907, 2010, 9 pages.

*Primary Examiner* — Tam M Nguyen
(74) *Attorney, Agent, or Firm* — Abelman, Frayne & Schwab

(57) ABSTRACT

Aromatics extraction and hydrocracking processes are integrated with a stream pyrolysis unit to optimize the performance of the hydrocracking units by processing the aromatic-rich and aromatic-lean fractions separately in order to better control the hydrocracking operating severity and/or catalyst reactor volume design requirements.

7 Claims, 5 Drawing Sheets

(56) References Cited

U.S. PATENT DOCUMENTS

2014/0353216 A1* 12/2014 Scibola ..... B01D 3/141
208/354
2016/0145511 A1 5/2016 Xu et al.

* cited by examiner

INTEGRATED AROMATIC SEPARATION PROCESS WITH SELECTIVE HYDROCRACKING AND STEAM PYROLYSIS PROCESSES

FIELD OF THE INVENTION

The present invention relates to hydrocracking processes and systems and, in particular, to a process for the efficient reduction of the catalyst-fouling nitrogen-containing aromatic compounds in a hydrocarbon mixture.

BACKGROUND OF THE INVENTION

Hydrocracking unit operations are in widespread use in petroleum refineries to process a variety of feeds. Conventional hydrocracking unit process feeds boil in the range of 370° C. to 520° C. and residue hydrocracking units treat feeds boiling above 520° C. In general, hydrocracking processes split the molecules of the feed into smaller, i.e., lighter molecules having higher average volatility and greater economic value. Additionally, hydrocracking typically improves the quality of the hydrocarbon feedstock by increasing the hydrogen-to-carbon ratio and by removing undesirable organosulfur and organonitrogen compounds. The significant economic benefit derived from hydrocracking operations has resulted in the development of substantial process improvements and improved catalysts with greater activity.

Conventional hydrocracking processes of the prior art subject the entire feedstock to the same hydrocracking reaction zones, necessitating operating conditions that must accommodate feed constituents that require increased severity for conversion, or alternatively sacrifice overall yield to attain desirable process economics.

Mild hydrocracking or single-stage hydrocracking operations, typically the simplest of the known hydrocracking configurations, proceed at operating conditions that are more severe than typical hydrotreating processes, and less severe than typical high pressure hydrocracking. Single or multiple catalysts systems can be used depending upon the nature and quality of feedstock and the product specifications. Multiple catalyst systems can be deployed as a stacked-bed configuration or in a series of reactors. Mild hydrocracking operations are generally more cost effective, but typically result in both a lower yield and reduced quality of the middle distillate products as compared to higher pressure hydrocracking operations.

In a series-flow configuration the entire hydrocracked product stream from the first reaction zone, including light gases, e.g., $C_1$-$C_4$, $H_2S$, $NH_3$, and all remaining hydrocarbons, are sent to a second reaction zone. In two-stage configurations, the feedstock is refined by passing it over a hydrotreating catalyst bed in the first reaction zone. The effluents are passed to a fractionating zone column to separate the light gases, naphtha and diesel products boiling in the temperature range of 36° C. to 370° C. The heavier hydrocarbons boiling above 370° C. are then passed to the second reaction zone for additional cracking.

Conventionally, most hydrocracking processes that are implemented for production of middle distillates and other valuable fractions retain aromatics with boiling points in the range of from about 180° C. to 370° C. Aromatics boiling at temperatures greater than the middle distillate range are also present in the heavier fractions.

In all of the hydrocracking process configurations described above, cracked products, along with partially cracked and unconverted hydrocarbons, are passed to a distillation column for separation into products that include naphtha, jet fuel/kerosene and diesel boiling in the nominal ranges of 36° C.-180° C., 180° C.-240° C. and 240° C.-370° C., respectively, with the unconverted products nominally boiling above 370° C. Typical jet fuel/kerosene fractions, e.g., those having a smoke point >25 mm, and diesel fractions, e.g., having a cetane number >52, are of high quality and well above the worldwide transportation fuel specifications. Although the hydrocracking unit products have relatively low aromaticity, any aromatics that do remain lower the key indicative properties of smoke point and cetane number for these products.

The lower olefins, i.e., ethylene, propylene, butylene and butadiene, and aromatics, i.e., benzene, toluene and xylene, are basic intermediates that are widely used in the petrochemical and chemical industries. Thermal cracking, or steam pyrolysis, is a widely used process for obtaining these compounds in the presence of steam and the absence of oxygen. Feedstocks for steam pyrolysis reactors can include petroleum gases and distillates such as naphtha, kerosene and gas oil. The availability of these feedstocks is usually limited and requires costly and energy-intensive processing for their production in a crude oil refinery.

Studies have been conducted using heavy hydrocarbons as a feedstock to steam pyrolysis reactors. A major drawback in conventional heavy hydrocarbon pyrolysis operations is coke formation. For example, a steam pyrolysis process for heavy liquid hydrocarbons is disclosed in U.S. Pat. No. 4,217,204 in which a mist of molten salt is introduced into a steam pyrolysis reaction zone in an effort to minimize coke formation. In one example using Arabian light crude oil having a Conradson carbon residue (CCR) of 3.1% by weight, the cracking apparatus was able to continue operating for 624 hours in the presence of molten salt. In a comparative example without the addition of molten salt, the steam pyrolysis reactor became clogged and inoperable after just 5 hours because of the formation of coke in the reactor.

In addition, the yields and distributions of olefins and aromatics when heavy hydrocarbons are used as the feedstock to a steam pyrolysis reactor are different than those using light hydrocarbon feedstocks. Heavy hydrocarbons have a higher content of aromatics than light hydrocarbons, as indicated by a higher Bureau of Mines Correlation Index (BMCI) which is a measurement of aromaticity of a feedstock that is calculated as follows:

$$BMCI=87552/VAPB+473.5*(SG)-456.8 \quad (1)$$

where:

VAPB=Volume Average Boiling Point in degrees Rankine and

SG=specific gravity of the feedstock.

As the BMCI decreases, ethylene yields are expected to increase. Therefore, highly paraffinic or low aromatic feeds are usually preferred for steam pyrolysis in order to obtain higher yields of desired olefins and to avoid undesirable products and coke formation in the reactor coil section.

Systems and methods for subjecting the hydrocarbon feed to an initial step of aromatic extraction and processing the aromatic-rich and aromatic-lean fractions separately and under different hydrocracking conditions is disclosed in U.S. Pat. Nos. 9,144,752, 9,144,753, 9,145,521 and 9,556,388, the disclosures of which are incorporated herein by reference. The systems and reactions schemes are directed to catalyzed hydroprocessing reactions, in multiple stages and, in some cases, in multiple reaction vessels with a first or second stage.

A problem addressed by the present disclosure is to provide an improved process and system for hydrocracking heavy hydrocarbon feedstocks to produce clean transportation fuels and light olefins that is cost effective and efficient.

A further problem addressed is the optimization of the design and operation of a hydrocracking unit to reduce the severity of the operating conditions and reduce catalyst reactor volume requirements for comparable product quality and outputs.

SUMMARY OF THE INVENTION

The above problems are resolved and additional advantages are realized by the process of the present disclosure in which the hydrocracking unit feed is separated into fractions containing different classes of compounds with different reactivities under the respective hydrocracking conditions to which they are subjected.

As used in the description and claims that follow, it will be understood that the term "hydrogen-rich" fraction refers to the fraction recovered from an aromatic separation process of the heavy hydrocarbon feed that contains a major portion of the paraffinic and olefinic compounds present in the initial feed, and that the term "hydrogen-lean" fraction refers to the fraction recovered from the aromatic separation process that contains a major portion of the aromatic compounds present in the initial feed.

Embodiment 1—Selective Single-Stage Hydrocracking System and Method

In accordance with an embodiment, the disclosure broadly comprehends an integrated hydrocracking process that includes a steam pyrolysis reactor for treating a heavy hydrocarbon feedstream containing aromatic, paraffinic and olefinic compounds that includes separating and hydrocracking a hydrogen-lean fraction of the initial feed which includes a majority of the aromatic compounds in the feed, and separately treating the remaining hydrogen-rich fraction that contains a major proportion of the non-aromatic compounds in the initial feed.

A single-stage once-through hydrocracker configuration, as described in more detail below, includes an integrated aromatic separation unit in which the feedstock is separated into a hydrogen-lean fraction and a hydrogen-rich fraction;

the hydrogen-lean fraction is passed to a hydrocracking reaction zone operating under conditions effective to hydrotreat and/or hydrocrack at least a portion of the aromatic compounds contained in the hydrogen-lean fraction to produce a hydrocracking reaction zone effluent;

the hydrogen-rich fraction is passed to a steam pyrolysis reaction zone operating under conditions effective to crack at least a portion of the paraffinic and naphthenic compounds present in the hydrogen-rich fraction to produce an effluent containing light olefins, gases and pyrolysis oil; and the hydrocracking reaction zone effluent and the second stream pyrolysis hydrocracking reaction zone effluent are combined and fractionated to produce one or more product streams and one or more bottoms streams.

Aromatic extraction operations typically do not provide sharp cut-offs between the aromatics and non-aromatics, so that the hydrogen-rich fraction contains a major proportion of the non-aromatic content of the initial feed and a minor proportion of the aromatic content of the initial feed, and the hydrogen-lean fraction contains a major proportion of the aromatic content of the initial feed and a minor proportion of the non-aromatic content of the initial feed. As will be apparent to one of ordinary skill in the art, the respective proportions of non-aromatic compounds in the hydrogen-lean fraction and the amount of aromatics in the hydrogen-rich fraction depend on various factors including the type of extraction process employed, the number of theoretical plates in the extractor (if applicable to the type of extraction employed), the type of solvent and the solvent ratio.

The feed portion that is extracted as the hydrogen-lean fraction includes aromatic compounds that contain heteroatoms and those that are free of heteroatoms. Aromatic compounds that contain heteroatoms that are extracted and recovered as part of the hydrogen-lean fraction generally include aromatic nitrogen compounds such as pyrrole, quinoline, acridine, carbazoles and their derivatives, and aromatic sulfur compounds such as thiophene, benzothiophenes and their derivatives, and dibenzothiophenes and their derivatives. These nitrogen- and sulfur-containing aromatic compounds are targeted in the aromatic separation step(s) generally by their solubility in the extraction solvent. In certain embodiments, removal of the nitrogen- and sulfur-containing aromatic compounds is enhanced by use of additional stages and/or selective sorbents. Various non-aromatic sulfur-containing compounds that can be present in the initial feed, i.e., prior to hydrotreating, include mercaptans, sulfides and disulfides. In a preferred embodiment, an aromatic extraction process and operating conditions are selected to minimize the amount of non-aromatic nitrogen- and sulfur-containing compounds that are passed with the hydrogen-lean fraction.

As used herein, the term "major proportion of the non-aromatic compounds" means at least greater than 50 weight % (W %) of the non-aromatic content of the feed to the extraction zone, and in certain embodiments at least greater than about 85 W %, and in other embodiments greater than at least about 95 W %. Also as used herein, the term "minor proportion of the non-aromatic compounds" means no more than 50 W % of the non-aromatic content of the feed to the extraction zone, and in certain embodiments no more than about 15 W %, and in other embodiments no more than about 5 W %.

Also as used herein, the term "major proportion of the aromatic compounds" means at least greater than 50 W % of the aromatic content of the feed to the extraction zone, and in certain embodiments at least greater than about 85 W %, and in other embodiments greater than at least about 95 W %. Also as used herein, the term "minor proportion of the aromatic compounds" means no more than 50 W % of the aromatic content of the feed to the extraction zone, and in certain embodiments no more than about 15 W %, and in other embodiments no more than about 5 W %.

Embodiment 2—Selective Series-Flow Hydrocracking System and Method to Produce Distillates and Light Olefins In accordance with one or more embodiments, the invention relates to systems and methods of combining conventional hydrocracking and steam pyrolysis of heavy hydrocarbon feedstocks to produce clean transportation fuels and light olefins. An integrated hydrocracking process includes hydrocracking a hydrogen-lean fraction of the initial feed and separately steam cracking a hydrogen-rich fraction.

A series-flow hydrocracker configuration that is described in more detail below includes an integrated aromatic separation unit in which the feedstock is separated into a hydrogen-lean fraction and a hydrogen-rich fraction;

the hydrogen-lean fraction is passed to a first stage hydrocracking reaction zone operating under conditions effective to hydrotreat and/or hydrocrack at least a portion of the aromatic compounds contained in the hydrogen-lean fraction and to produce a first stage hydrocracking reaction zone effluent;

the hydrogen-rich fraction is passed to a steam pyrolysis reaction zone operating under conditions effective to crack at least a portion of the paraffinic and naphthenic compounds contained in the hydrogen-rich fraction and to produce a steam pyrolysis reaction zone effluent;

the first stage hydrocracking reaction zone effluent is passed to a second stage hydrocracking reaction zone to produce a second stage hydrocracking reaction zone effluent; and the steam pyrolysis reaction zone effluent is fractionated in a fractionating zone to produce a product stream and a bottoms stream that are separately recovered.

Embodiment 3—Selective Hydrocracking System and Method to Produce Distillates and Light Olefins In accordance with an embodiment, the disclosure broadly comprehends methods of hydrocracking heavy hydrocarbon feedstocks to produce clean transportation fuels. An integrated aromatic separation, hydrocracking and steam pyrolysis process includes hydrocracking a hydrogen-lean fraction of the initial feed separately from a hydrogen-rich fraction.

A series-flow hydrocracker described in more detail below includes an integrated aromatic separation unit in which the feedstock is separated into a hydrogen-lean fraction and a hydrogen-rich fraction;

the hydrogen-lean fraction is passed to a first stage hydrocracking reaction zone operating under conditions effective to hydrotreat and/or hydrocrack at least a portion of the aromatic compounds contained in the hydrogen-lean fraction and to produce a first stage hydrocracking reaction zone effluent;

a mixture of the first stage hydrocracking reaction zone effluent after gas-liquid separation and the hydrogen-rich fraction is passed to a steam pyrolysis reaction zone to produce a combined steam cracked hydrocarbon pyrolysis reaction zone effluent; and the steam cracked hydrocarbon pyrolysis reaction zone effluent is fractionated in a fractionating zone to produce a product stream and a bottoms stream that are separately recovered.

Embodiment 4—Selective Two-Stage Hydrocracking System and Method to Produce Distillates and Light Olefins In accordance with an embodiment, the invention relates to systems and methods of hydrocracking and steam pyrolysis of heavy hydrocarbon feedstocks to produce clean transportation fuels and light olefins. An integrated hydrocracking process includes hydrocracking a hydrogen-lean fraction of the initial feed separately from a hydrogen-rich fraction.

A two-stage hydrocracker configuration that is described in more detail below includes an integrated aromatic separation unit in which the feedstock is separated into a hydrogen-lean fraction and a hydrogen-rich fraction;

the hydrogen-lean fraction is passed to a first vessel of a first stage hydrocracking reaction zone operating under conditions effective to hydrotreat and/or hydrocrack at least a portion of the aromatic compounds present in the hydrogen-lean fraction and to produce a first stage hydrocracking reaction zone effluent;

the hydrogen-rich fraction is passed to a steam pyrolysis reaction zone operating under conditions effective to crack at least a portion of the paraffinic and naphthenic compounds contained in the hydrogen-rich fraction to produce a steam cracked reaction zone effluent;

a mixture of the first vessel first stage hydrocracking reaction zone effluent and the steam pyrolysis reaction zone effluent is fractionated in a fractionating zone to produce a product stream and a bottoms stream;

at least a portion of fractionating zone bottoms stream is passed to a second stage hydrocracking reaction zone to produce a second stage hydrocracking reaction zone effluent; and the second stage hydrocracking reaction zone effluent is passed to the fractionating zone.

Embodiment 5—Selective Two-Stage Hydrocracking System and Method to Produce Distillates and Light Olefins In accordance with an embodiment, the disclosure broadly comprehends methods for the hydrocracking and steam pyrolysis of heavy hydrocarbon feedstocks to produce clean transportation fuels and light olefins. An integrated hydrocracking process includes hydrocracking a hydrogen-lean fraction of the initial feed separately from a hydrogen-rich fraction.

A two-stage hydrocracker configuration that is described in more detail below, includes an integrated aromatic separation unit in which the feedstock is separated into a hydrogen-lean fraction and a hydrogen-rich fraction;

the hydrogen-lean fraction is passed to a first stage hydrocracking reaction zone operating under conditions effective to hydrotreat and/or hydrocrack at least a portion of the aromatic compounds contained in the hydrogen-lean fraction and to produce a first stage hydrocracking reaction zone effluent;

the first stage hydrocracking reaction zone effluent is separated to produce a product stream and a bottoms stream, and at least a portion of the bottoms stream is mixed with the hydrogen-rich fraction; and the mixture is passed to a steam pyrolysis reaction zone to produce a steam cracked reaction zone effluent which is passed to a fractionating zone for separation and recovery of products.

Still other aspects, embodiments and advantages of these exemplary processes are described in detail below. Moreover, it is to be understood that both the foregoing and the following detailed description are illustrative examples of various aspects and embodiments, and are intended to provide an overview or framework for understanding the nature and character of the broad aspects and embodiments of the processes. The accompanying drawings illustrate by example and facilitate an understanding of the various aspects and process embodiments. The drawings, together with the remainder of the specification, serve to explain principles and practice of the process.

BRIEF DESCRIPTION OF THE DRAWINGS

Embodiments of processes and systems, and of apparatus for the practice of the present disclosure will be described in more detail below and with reference to the attached drawings in which the same or similar elements are referred to by the same number, and where.

DETAILED DESCRIPTION OF THE INVENTION

Figure 1:
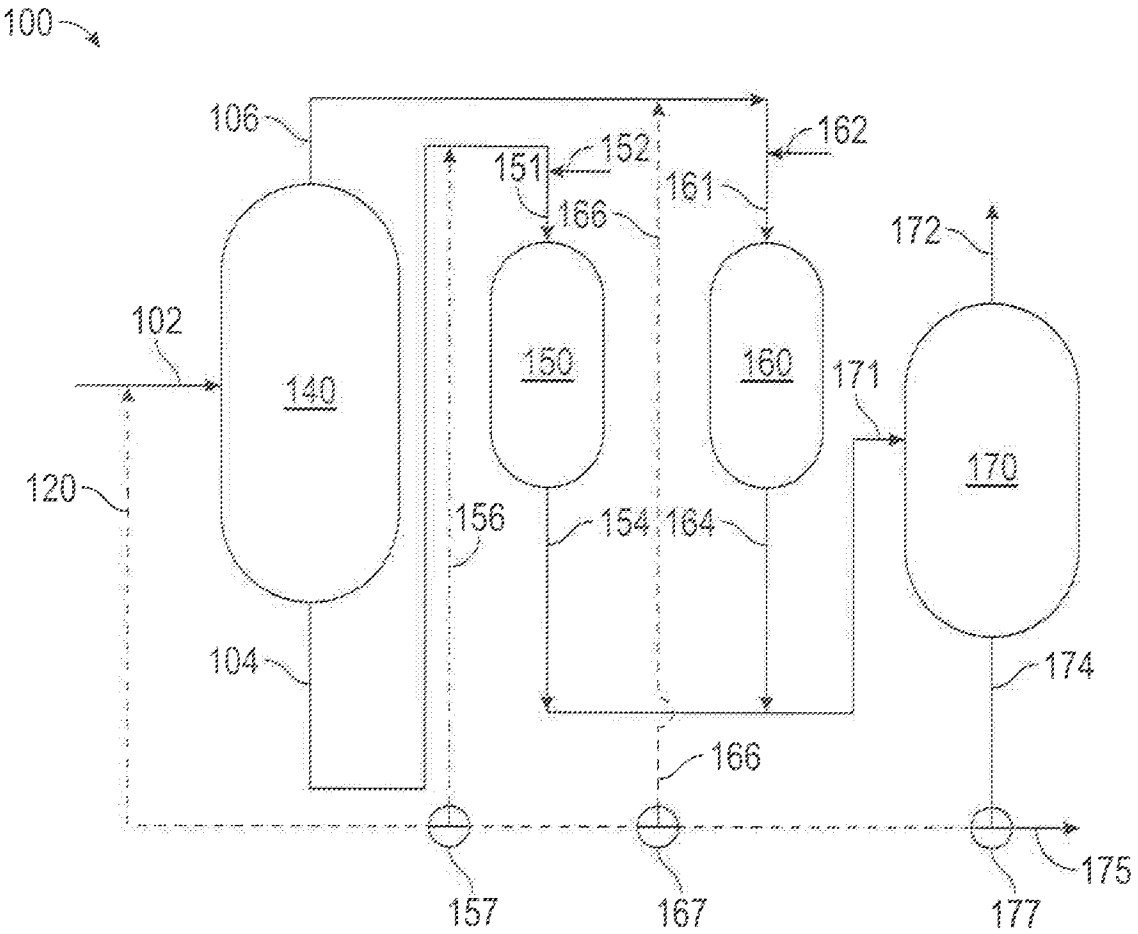
FIG. 1 is a simplified schematic flow diagram of an embodiment of a single stage hydrocracking system suitable for practicing the process of the disclosure.

Referring to the schematic illustration of FIG. 1, a process flow diagram of an integrated hydrocracking apparatus and system 100 in the configuration of a single-stage hydrocracking unit apparatus and system is shown. Apparatus 100 includes an aromatic extraction zone 140, a hydrocracking reaction zone 150 containing a hydrocracking catalyst, a steam pyrolysis reaction zone 160, and a fractionating zone 170.

Aromatic extraction zone 140 includes at least a hydrocarbon feed inlet 102, a hydrogen-lean stream outlet 104 and a hydrogen-rich stream outlet 106. In certain embodiments, feed inlet 102 is in fluid communication with fractionating zone 170 via an optional recycle conduit 120 to receive all or a portion of the fractionator bottoms 174. Various embodiments of and/or unit-operations utilized in aromatic separation zone 140 are employed in accordance with the prior art based on the characteristics of the aromatics present in the initial feed.

Hydrocracking reaction zone 150 includes an inlet 151 in fluid communication with hydrogen-lean stream outlet 104, a source of hydrogen gas received via a conduit 152, and a hydrocracking reaction zone effluent outlet 154. In certain embodiments, inlet 151 is in fluid communication with fractionating zone 170 via an optional recycle conduit 156 to receive all or a portion of the fractionator bottoms 174, with the flow controlled by three-way valve 157.

Hydrocracking reaction zone 150 is generally operated under severe conditions to treat the hydrogen-lean stream. As used herein, the term "severe conditions" is relative and it is to be understood that the ranges of operating conditions depend on the specific composition of the feedstock being processed. In certain embodiments, these conditions can include a reaction temperature in the range of from about 300° C. to 500° C., and in certain embodiments from about 380° C. to 450° C.; a reaction pressure in the range of from about 100 bars to 200 bars, and in certain embodiments from about 130 bars to 180 bars; a hydrogen feed rate up to about 2500 standard liters per liter of hydrocarbon feed (SLt/Lt), in certain embodiments from about 500 to 2500 SLt/Lt, and in further embodiments from about 1000 to 1500 SLt/Lt; and a feed rate in the range of from about 0.25 $h^{-1}$ to 3.0 $h^{-1}$, and in certain embodiments from about 0.5 $h^{-1}$ to 1.0 $h^{-1}$.

The catalyst used in hydrocracking reaction zone 150 has one or more active metal components selected from IUPAC Groups 6-10 of the Periodic Table of the Elements. In certain embodiments, the active metal component is one or more of cobalt, nickel, tungsten and molybdenum, typically deposited or otherwise incorporated on a support, e.g., alumina, silica-alumina, silica, or zeolites.

Steam pyrolysis reaction zone 160 includes an inlet 161 in fluid communication with hydrogen-rich stream outlet 106 and with a source of steam via a conduit 162, and a steam pyrolysis reaction zone effluent outlet 164. In certain embodiments, inlet 161 is in fluid communication with fractionating zone 170 via an optional recycle conduit 166 to receive all or a portion of the bottoms 174, with the flow controlled by three-way valve 167.

Steam pyrolysis reaction zone 160 can be operated at a temperature in the broad range of from 400° C. to 900° C., but a preferred operating range is between 800° C. to 900° C. in the convection section and in the pyrolysis section; a pressure in the convection section in the range of 1 bar to 3 bars, and a pressure in the pyrolysis section in the range of 1 bar to 3 bars; a steam-to-hydrocarbon ratio in the convection section in the range of 0.3:1 to 2:1; and a residence time in the convection section and in the pyrolysis section in the range of from 0.05 seconds to 2 seconds.

Fractionating zone 170 includes an inlet 171 in fluid communication with hydrocracking reaction zone effluent outlet 154 and steam pyrolysis reaction zone effluent outlet 164. Fractionating zone 170 also includes a product stream outlet 172 and a bottoms stream outlet 174. Note that while one product outlet is shown for simplicity, it will be understood by one of skill in the art that multiple product fractions can and are typically recovered from fractionating zone 170. In addition, while one fractionating zone 170 is shown in fluid communication with both effluents 154 and 164 from the hydrocracking and steam pyrolysis reaction zones 150, 160, respectively, in certain embodiments separate fractionating zones (not shown) can be employed in order to meet the required specifications for products contained in one or both of effluent streams 154 and 164.

The hydrocarbon feedstock is introduced via inlet 102 to the aromatic extraction zone 140 for extraction of a hydrogen-lean fraction 106 and a hydrogen-rich fraction 104. Optionally, the feedstock 102 is combined with all or a portion of the bottoms 174 from fractionating zone 170 via recycle conduit 120, with the flow controlled by a three-way valve.

The hydrogen-lean fraction 104 generally includes a major proportion of the aromatic nitrogen- and sulfur-containing compounds that were initially in the feedstock and a minor proportion of non-aromatic compounds that were initially in the feedstock. Aromatic nitrogen-containing compounds that are extracted into the hydrogen-lean fraction include pyrrole, quinoline, acridine, carbazole, and their derivatives. Aromatic sulfur-containing compounds that are extracted and constitute part of the hydrogen-lean fraction include thiophene, benzothiophene and its long chain alkylated derivatives, and dibenzothiophene and its alkyl derivatives such as 4,6-dimethyl-dibenzothiophene. The hydrogen-rich fraction generally includes a major proportion of the non-aromatic compounds that initially were in the feedstock and a minor proportion of the aromatic nitrogen- and sulfur-containing compounds that initially were in the feedstock. The hydrogen-rich fraction is substantially free of refractory nitrogen-containing compounds, and the hydrogen-lean fraction contains nitrogen-containing aromatic compounds when the extraction process is operating optimally.

The hydrogen-lean fraction discharged via outlet 104 is passed to inlet 151 of hydrocracking reaction zone 150 and mixed with hydrogen gas introduced via conduit 152.

Optionally, the hydrogen-lean fraction is combined with all or a portion of the bottoms 174 from fractionating zone 170 via recycle conduit 156 with the flow controlled by three-way valve 157. Compounds contained in the hydrogen-lean fraction including aromatic compounds are hydrotreated and/or hydrocracked. The hydrocracking reaction zone 150 is operated under relatively severe conditions. In certain embodiments, these relatively severe operating conditions of the hydrocracking reaction zone 150 are more severe than conventionally known severe hydrocracking conditions due to the comparatively higher concentration of aromatic nitrogen- and sulfur-containing compounds. In accordance with the advantages of the present disclosure, the capital and operational costs of these more severe conditions are offset by the reduced volume of hydrogen-lean feed processed in the hydrocracking reaction zone 150 as compared to a full range feed that would be processed in a conventional severe hydrocracking unit operation of the prior art. The resulting advantages also include an improved production rate of the desired products.

The hydrogen-rich fraction discharged via outlet 106 is passed to inlet 161 of the steam pyrolysis reaction zone 160 and mixed with steam introduced via conduit 162. Optionally, the hydrogen-rich fraction is combined with all or a portion of the bottoms 174 from fractionating zone 170 via recycle conduit 166, with flow controlled by three-way valve 167. Compounds contained in the hydrogen-rich fraction including paraffins and naphthenes are steam cracked. The steam pyrolysis reaction zone 160 is operated under the conditions described above.

The hydrocracking reaction zone and steam pyrolysis zone effluents are sent to one or more intermediate separator vessels (not shown) to remove gases including excess $H_2$, $H_2S$, $NH_3$, methane, ethane, ethylene, propane, propylene, butanes and butylenes. The liquid effluents are passed to inlet 171 of the fractionating zone 170 for recovery of liquid products via outlet 172 which can include naphtha nominally boiling in the range of from about 36° C. to 180° C. and diesel nominally boiling in the range of from about 180° C. to 370° C. The bottoms stream discharged via outlet 174 includes unconverted hydrocarbons and/or partially cracked hydrocarbons which can include those having a boiling temperature above about 370° C. It is to be understood that the product cut points between fractions are representative only, and that in practice cut points are selected based on design characteristics and known considerations for a particular feedstock. For instance, the values of the cut points can vary by up to about 30° C. in the embodiments described. In addition, it is also to be understood that while the integrated system is shown and described with one fractionating zone 170, in certain embodiments separate fractionating zones can be operated with greater control of the temperatures in order to enhance the recovery of specific products.

All or a portion of the bottoms can be purged via conduit 175, e.g., for processing in other unit operations or refineries. In certain embodiments, in order to maximize yields and conversions of the original hydrocarbon feeds to the system, a portion of bottoms 174 is optionally recycled to the aromatic separation unit 140, the hydrocracking reaction zone 150 and/or the steam pyrolysis reaction zone 160, as represented by dashed-lines 120, 156 and 166, respectively.

EXAMPLE

Embodiment 1

A sample of vacuum gas oil (VGO) derived from Arab light crude oil was solvent extracted in an extractor at 60° C. and atmospheric pressure using furfural at a solvent-to-oil ratio of 1.1:1.0 to produce a hydrogen-lean fraction and a hydrogen-rich fraction. The hydrogen-rich fraction yield was 52.7 W % and contained 0.43 W % of sulfur and 5 W % of aromatics. The hydrogen-lean fraction yield was 47.3 W % and contained 95 W % of aromatics and 2.3 W % of sulfur. The properties of the VGO, hydrogen-lean fraction and hydrogen-rich fraction are reported in Table 1.

TABLE I

| Property | | VGO | VGO Aromatic-Rich | VGO Aromatic-Lean |
|---|---|---|---|---|
| Density at 15 ° C. | Kg/L | 0.922 | 1.020 | 0.835 |
| Carbon | W % | 85.27 | | |
| Hydrogen | W % | 12.05 | | |
| Sulfur | W % | 2.7 | 2.30 | 0.43 |
| Nitrogen | ppmw | 615 | 584 | 31 |
| MCR | W % | 0.13 | | |
| Aromatics | W % | 47.3 | 44.9 | 2.4 |
| N + P | W % | 52.7 | 2.6 | 50.1 |

The hydrogen-lean fraction was hydrotreated in a fixed-bed hydrotreating unit containing a Ni—Mo on amorphous silica-alumina catalyst at 150 Kg/cm hydrogen partial pressure, 400° C., liquid hourly space velocity of 1.0/hr and a hydrogen feed rate of 1,000 SLt/Lt. The Ni—Mo catalyst was used to denitrogenize the hydrogen-lean fraction, which included a significant amount of the nitrogen content that was present in the original feedstock. The effluents are sent to a fractionator.

The hydrogen-rich fraction was subjected to steam pyrolysis at 800° C., at 1 bar, and a steam-to-hydrocarbon weight ratio of 0.6 for 0.35 seconds. The effluents from the hydrocracking and steam pyrolysis unit are sent to one or more separator vessels to remove gases and the liquid effluents are passed to the fractionation zone to recover the liquid products. The hydrogen lean stream and the bottoms from both units can be recycled, e.g., to the steam pyrolysis unit, in order to maximize yields.

The respective product yields resulting from the integrated hydrocracking and steam pyrolysis operations are reported in Table 2.

TABLE 2

| Property | Hydrocracking, W % VGO-Aromatic Rich | Steam pyrolysis, W % VGO-Aromatic Lean | W % Overall |
|---|---|---|---|
| Stream # | 154 | 164 | 171 |
| Hydrogen | 2.39 | 0.8 | 1.55 |
| $H_2S$ | 2.42 | 0 | 1.14 |
| $NH_3$ | 0.07 | 0 | 0.03 |
| Ethylene | | 20.5 | 10.80 |
| Propylene | | 14.0 | 7.38 |
| Butadiene | | 5.3 | 2.79 |
| $C_0$-$C_4$ | 2.78 | 15.1 | 9.27 |
| Naphtha | 19.08 | 19.3 | 19.20 |
| Mid Distillates | 38.04 | 0 | 18.00 |
| Unconverted Bottoms | 40.00 | 25.00 | 32.10 |
| Total | 102.39 | 100 | 101.13 |
| Conversion | 60.00 | 75.00 | 67.90 |

Figure 2:
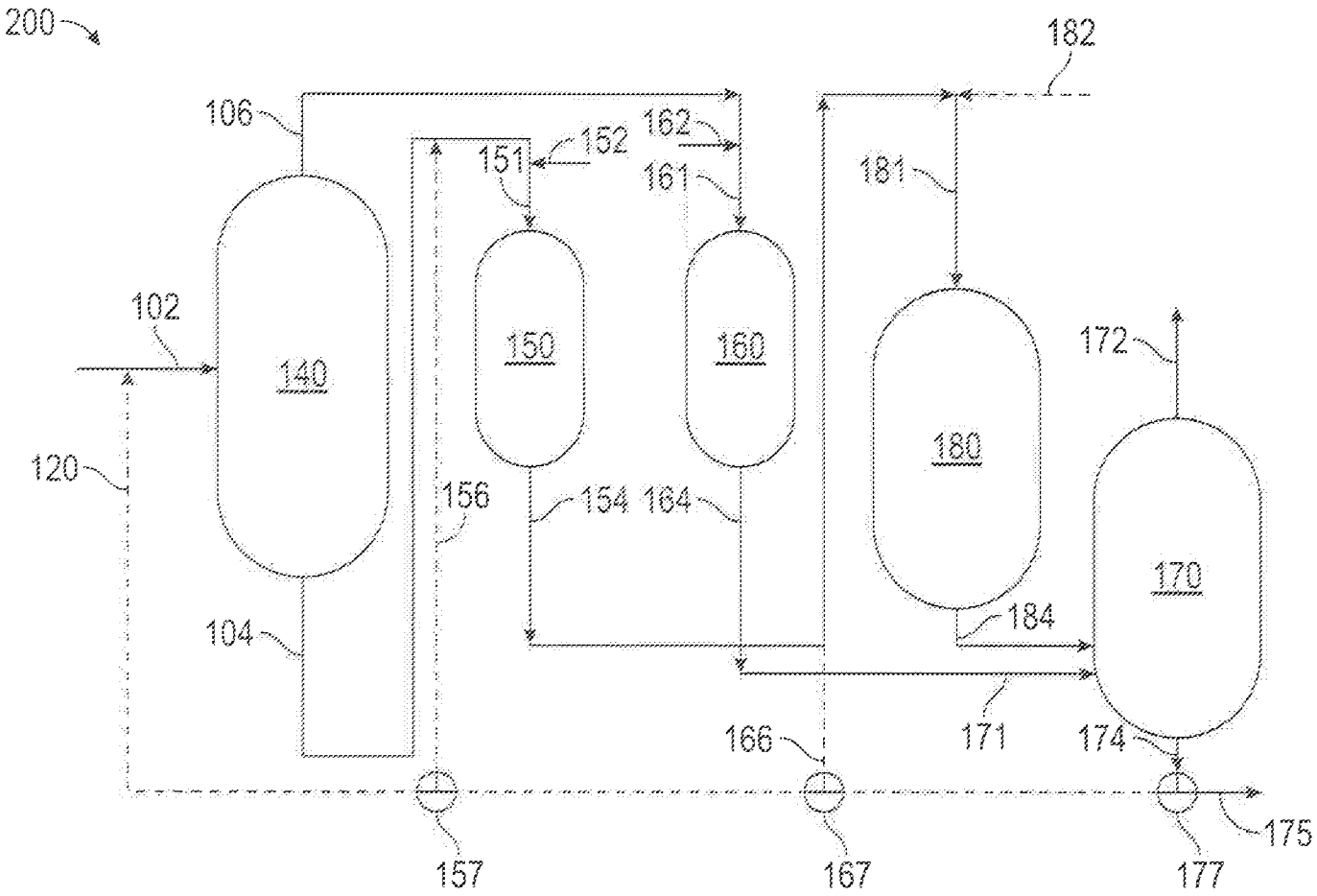
FIG. 2 is a simplified schematic flow diagram of an embodiment of a selective series-flow hydrocracking system suitable for practicing the process of the disclosure.

Referring now to FIG. 2, there is shown a process flow diagram of an integrated hydrocracking apparatus and system 200 in the configuration of a series-flow hydrocracking unit that includes an aromatic extraction zone 140, containing a first vessel of a first stage hydrocracking reaction zone 150 containing a first stage hydrocracking catalyst, a second vessel 180 of the first stage hydrocracking reaction zone containing a second stage hydrocracking catalyst, a steam pyrolysis reaction zone 160, and a fractionating zone 170.

Aromatic extraction zone 140 includes a feed inlet 102, a hydrogen-lean stream outlet 104 and a hydrogen-rich stream outlet 106. In certain embodiments, feed inlet 102 is in fluid communication with fractionating zone 170 via an optional recycle conduit 120 to receive all or a portion of the bottoms 174 with the flow controlled by one or more three-way valves.

As illustrated, first vessel 150 includes an inlet 151 in fluid communication with hydrogen-lean stream outlet 104 and a source of hydrogen gas introduced via a conduit 152. First vessel 150 of the first stage hydrocracking reaction zone also includes a first vessel first stage hydrocracking reaction zone effluent outlet 154. In certain embodiments, inlet 151 is in fluid communication with fractionating zone 170 via an optional recycle conduit 156 to receive all or a portion of the bottoms 174, with flow controlled by three-way valve 157, 167 and 177, respectively.

First vessel 150 of first stage hydrocracking reaction zone is operated under severe conditions. As used herein, the "severe conditions" are relative and it is to be understood that the ranges of operating conditions depend on the feedstock being processed. In certain embodiments of the process described with reference to FIG. 2, these conditions can include a reaction temperature in the range of from about 300° C. to 500° C., and in certain embodiments from about 380° ° C. to 450° C.; a reaction pressure in the range of from about 100 bars to 200 bars, and in certain embodiments from about 130 bars to 180 bars; a hydrogen feed rate not exceeding about 2,500 standard liters per liter of hydrocarbon feed (SLt % Lt), and in certain embodiments from about 500 to 2,500 SLt/Lt, and in further embodiments from about 1,000 to 1,500 SLt/Lt; and a feed rate in the range of from about 0.25 $h^{-1}$ to 3.0 $h^{-1}$, and in certain embodiments from about 0.5 $h^{-1}$ to 1.0 $h^{-1}$.

The catalyst used in the first vessel of first stage hydrocracking reaction zone has one or more active metal components selected from IUPAC Groups 6-10 of the Periodic Table of the Elements. In certain embodiments, the active metal component is one or more of cobalt, nickel, tungsten and molybdenum, which can be deposited or otherwise incorporated on a support, e.g., alumina, silica-alumina, silica, or zeolites.

The steam pyrolysis reaction zone includes vessel 160 with inlet 161 in fluid communication with hydrogen-rich stream outlet 106 and a source of steam introduced via conduit 162. Vessel 160 of the steam pyrolysis reaction zone also includes a steam pyrolysis reaction zone effluent outlet 164.

The steam pyrolysis reaction zone 160 can be operated at a temperature in the broad range of from 400° C. to 900° C., but a preferred operating range is between 800° to 900° C. in the convection section and in the pyrolysis section; a pressure in the convection section in the range of 1 bar to 3 bars, and a pressure in the pyrolysis section in the range of 1 bar to 3 bars; a steam-to-hydrocarbon ratio in the convection section in the range of 0.3; 1 to 2:1; and a residence time in the convection section and in the pyrolysis section in the range of from 0.05 seconds to 2 seconds.

The second hydrocracking reaction zone 180 includes an inlet 181 in fluid communication with the first vessel first stage hydrocracking reaction zone effluent outlet 154. In certain embodiments, inlet 181 is in fluid communication with fractionating zone 170 via an optional recycle conduit 166 to receive all or a portion of the bottoms 174.

The second vessel 180 of the second stage hydrocracking reaction zone is operated under conditions that include a reaction temperature in the range of from about 300° C. to 500° C., and in certain embodiments from about 330° C. to 420° C.; a reactor pressure in the range of from about 30 bars to 130 bars, and in certain embodiments from about 60 bars to 100 bars; a hydrogen feed rate below 2,500 SL/Lt, and in certain embodiments from about 500 to 2,500 SLt/Lt, and in further embodiments from about 1,000 to 1,500 SLt/Lt; and a feed rate in the range of from about 1.0 $h^{-1}$ to 5.0 $h^{-1}$, and in certain embodiments from about 2.0 $h^{-1}$ to 3.0 $h^{-1}$.

The catalyst used in the second hydrocracking reaction zone has one or more active metal components selected from IUPAC Groups 6-10 of the Periodic Table of the Elements. In certain embodiments the active metal component is one or more of cobalt, nickel, tungsten and molybdenum, that can be deposited or otherwise incorporated on a support, e.g., alumina, silica-alumina, silica, or zeolites.

Fractionating zone 170 includes an inlet 171 in fluid communication with the steam pyrolysis reaction zone effluent 164 and second hydrocracking reaction zone outlet 184, a product stream outlet 172 and a bottoms stream outlet 174. Note that while one product outlet is shown in this simplified schematic illustration of the system, multiple product fractions will advantageously be recovered in practice from fractionating zone 170.

A hydrocarbon feedstock is introduced via inlet 102 of the aromatic extraction zone 140 for extraction of a hydrogen-lean fraction and a hydrogen-rich fraction. Optionally, the feedstock can be combined with all or a portion of the bottoms 174 from the fractionating zone 170 via recycle conduit 120 following passage through three-way valves 177, 167 and 157, respectively.

The hydrogen-lean fraction generally includes a major proportion of the aromatic nitrogen- and sulfur-containing compounds that were initially in the feedstock and a minor proportion of non-aromatic compounds that were initially in the feedstock. Aromatic nitrogen-containing compounds that are extracted into the hydrogen-lean fraction include pyrrole, quinoline, acridine, carbazole, and their derivatives. Aromatic sulfur-containing compounds that are extracted into the hydrogen-lean fraction include thiophene, benzothiophene and its long chain alkylated derivatives, and dibenzothiophene and its alkyl derivatives such as 4,6-dimethyldibenzothiophene. The hydrogen-rich fraction generally includes a major proportion of the non-aromatic compounds that were in the initial feedstock and a minor proportion of the aromatic nitrogen- and sulfur-containing compounds that were in the initial feedstock. The hydrogen-rich fraction is almost free of refractory nitrogen-containing compounds, and the hydrogen-lean fraction contains nitrogen-containing aromatic compounds.

The hydrogen-lean fraction discharged via outlet 104 is passed to inlet 151 of first vessel 150 of the first stage hydrocracking reaction zone and mixed with hydrogen gas introduced via conduit 152. Optionally, the hydrogen-lean fraction is combined with all or a portion of the bottoms 174 from fractionating zone 170 via recycle conduit 156. Compounds contained in the hydrogen-lean fraction that include aromatic compounds are hydrotreated and/or hydrocracked. The first vessel 150 of the first stage hydrocracking reaction zone is operated under relatively severe conditions. In certain embodiments, these relatively severe operating conditions of the first vessel 150 are more severe than conventionally known severe hydrocracking conditions due to the comparatively higher concentration of aromatic nitrogen- and sulfur-containing compounds. In accordance with the advantages of the disclosed process, the capital and operational costs of these more severe conditions are offset by the reduced volume of hydrogen-lean feed that would be processed in the first vessel 150 as compared to a full range feed processed in a conventionally known severe hydrocracking unit operation of the prior art.

The hydrogen-rich fraction discharged via outlet 106 is passed to inlet 161 of the steam pyrolysis vessel 160 and mixed with hydrogen gas introduced via conduit 162. Compounds contained in the hydrogen-rich fraction, including paraffins and naphthenes are steam cracked.

The first stage hydrocracking reaction zone effluent discharged via outlet 154 is passed to inlet 181 of the second stage hydrocracking reaction zone 180. Compounds contained in the mixture of the first stage hydrocracking reaction zone effluent are combined with hydrogen gas via inlet 182 and hydrotreated and/or hydrocracked. In an embodiments, the hydrogen content, either free or dissolved in the first stage hydrocracker effluent is monitored in real time and the pressure/flow the hydrogen source via inlet 182 to reaction zone 180 can be reduced if there is no or a reduced requirement for additional hydrogen, e.g., the hydrogen that is provided via conduit 152 and passes unreacted to the second stage hydrocracking reaction zone 180.

The second vessel 180 of the second stage hydrocracking zone is operated under relatively mild racking conditions, which can be milder than the conventionally known mild hydrocracking conditions due to the comparatively lower concentration of aromatic nitrogen- and sulfur-containing compounds, thereby reducing capital and operational costs.

The second stage hydrocracking reaction zone effluent is sent to one or more intermediate separator vessels (not shown) to remove gases including excess $H_2$, $H_2S$, $NH_3$, methane, ethane, ethylene, propane, propylene, butanes and butylenes. The liquid effluents are passed to inlet 171 of the fractionating zone 170 for recovery of liquid products via outlet 172, including, for instance, naphtha boiling in the nominal range of from about 36° C. to 180° C. and diesel boiling in the nominal range of from about 180° C. to 370° C. In practice, the compounds would be recovered via separate outlets, depicted here for simplicity, as the single outlet 172. The bottoms stream discharged via outlet 174 includes unconverted hydrocarbons and/or partially cracked hydrocarbons, for instance, having a boiling temperature above about 370° C. It is to be understood that the product cut points between fractions are representative only and in practice cut points are selected based on design characteristics and on particular feedstocks. For instance, the values of the cut points can vary by up to about 30° C. in the embodiments described. In addition, it is to be understood that while the integrated system is shown and described with one fractionating zone 170, in certain embodiments separate fractionating zones can be employed to provide better temperature and separation control for recovery of specific fractions required to meet particular product specifications.

All or a portion of the bottoms from the fractionating zone 170 can be purged via conduit 175, e.g., for processing in other unit operations or refineries. In certain embodiments, in order to maximize yields and conversions, a portion of bottoms 174 is recycled to the aromatic separation unit 140, the first vessel 150 of the first stage hydrocracking reaction zone and/or the steam pyrolysis reaction zone 160, as represented by dashed-lines 120, 156 and 186, respectively, with the flow(s) controlled by one or more three-way valves 157, 167 and 177, as described above.

Figure 3:
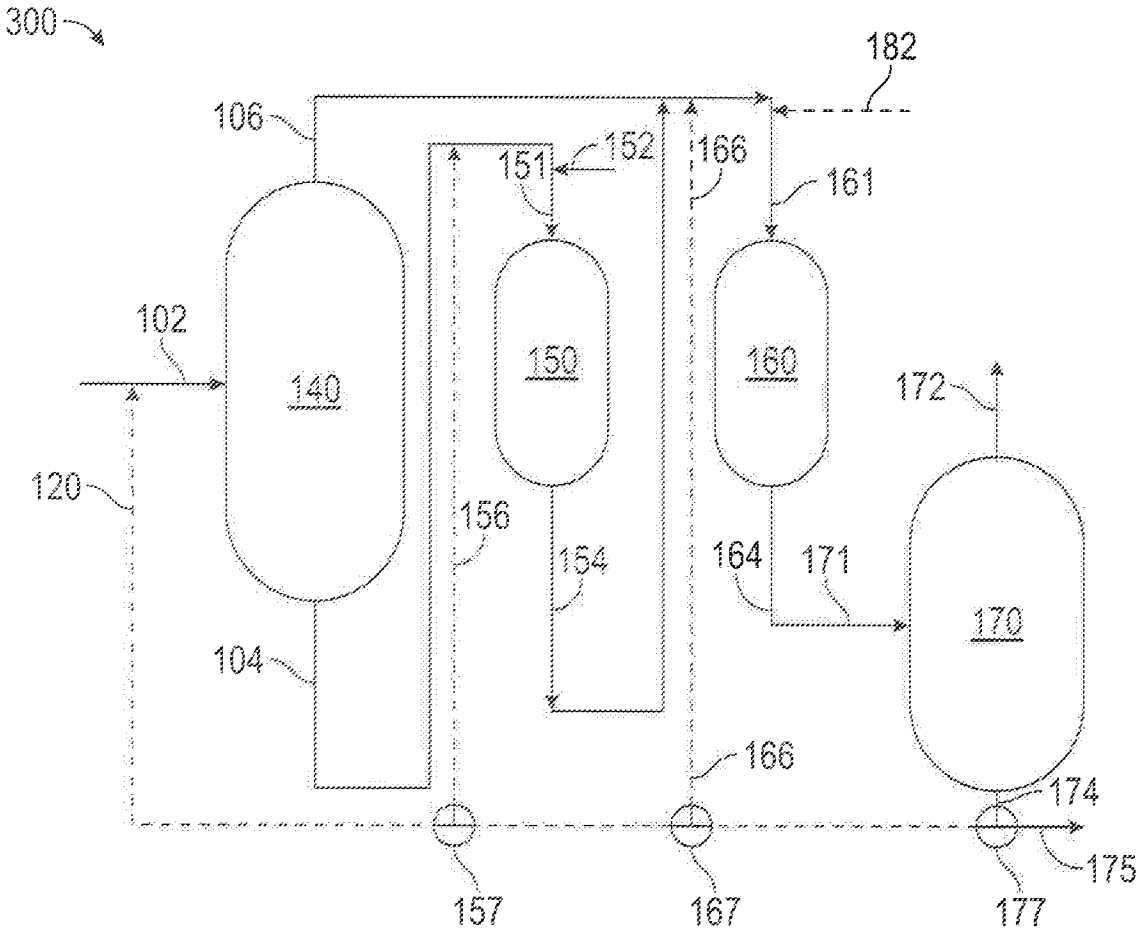
FIG. 3 is a simplified schematic flow diagram of an embodiment of a selective hydrocracking system suitable for practicing the process of the disclosure.

Referring now to FIG. 3, a process flow diagram is provided for an integrated aromatic separation, hydrocracking and steam pyrolysis apparatus and system 300 in the configuration of a hydrocracking unit apparatus. System 300 includes an aromatic extraction zone 140, a hydrocracking reaction zone 150 containing a first stage hydrocracking catalyst, a steam pyrolysis reaction zone 160 and a fractionating zone 170.

Aromatic extraction zone 140 includes a feed inlet 102, a hydrogen-lean stream outlet 104 and a hydrogen-rich stream outlet 106. As explained in more detail below, in certain embodiments, feed inlet 102 is in fluid communication with downstream fractionating zone 170 via an optional recycle conduit 120 to receive all or a portion of the bottoms 174, with the flow controlled by three-way valves 177, 167 and 157. Various embodiments of and/or unit-operations contained within aromatic separation zone 140 are configured and operated to achieve maximum efficiency for the specific feedstock(s) being processed in accordance with principles and practices known in the art.

Hydrocracking reaction zone 150 comprises an inlet 151 in fluid communication with hydrogen-lean stream outlet 104 and a source of hydrogen gas introduced via conduit 152. First stage hydrocracking reaction zone 150 also includes a hydrocracking reaction zone effluent outlet 154. In certain embodiments, inlet 151 is in fluid communication with fractionating zone 170 via an optional recycle conduit 156 to receive all or a portion of the bottoms 174.

Hydrocracking reaction zone 150 is operated under severe conditions. As used herein, the term "severe conditions" is relative and the ranges of operating conditions depend on the feedstock being processed. For instance, these conditions can include a reaction temperature in the range of from about 300° C. to 500° C., and in certain embodiments from about 380° C. to 450° C.; a reaction pressure in the range from about 100 bars to 200 bars, and in certain embodiments from about 130 bars to 180 bars; a hydrogen feed rate below about 2500 standard liters per liter of hydrocarbon feed (SLt/Lt), and in certain embodiments from about 500 to 2500 SLt/Lt, and in further embodiments from about 1000 to 1500 SLt/Lt; and a feed rate in the range of from about 0.25 $h^{-1}$ to 3.0 $h^{-1}$, and in certain embodiments from about 0.5 $h^{-1}$ to 1.0 $h^{-1}$.

The catalyst used in the hydrocracking reaction zone has one or more active metal components selected from IUPAC Groups 6-10 of the Periodic Table of the Elements. In certain embodiments the active metal component is one or more of cobalt, nickel, tungsten and molybdenum, typically deposited or otherwise incorporated on a support, e.g., alumina, silica-alumina, silica, or zeolites.

Steam pyrolysis reaction zone 160 includes an inlet 161 in fluid communication with hydrogen-rich stream outlet 106, first stage hydrocracking reaction zone liquid effluent outlet 154 after gas-liquid separation (not shown) and steam introduced via a conduit 162, and a steam pyrolysis reaction zone effluent outlet 164. In certain embodiments, inlet 161 is in fluid communication with fractionating zone 170 via an optional recycle conduit 166 to receive all or a portion of the bottoms 174.

Steam pyrolysis reaction zone 160 can be operated at a temperature in the broad range of from 400° C. to 900° C., but a preferred operating range is between 800° C. to 900° C. in the convection section and in the pyrolysis section; a pressure in the convection section in the range of 1 bar to 3 bars, and in the pyrolysis section of 1 bar to 3 bars; a steam-to-hydrocarbon ratio in the convection section in the range of 0.3:1 to 2:1; and a residence time in the convection section and in the pyrolysis section in the range of from 0.05 seconds to 2 seconds.

Fractionating zone 170 includes an inlet 171 in fluid communication with the steam pyrolysis reaction zone effluent outlet 184, a product stream outlet 172 and a bottoms stream outlet 174. Note that while one product outlet is shown, multiple product fractions can also be recovered from fractionating zone 170.

A feedstock is introduced via inlet 102 of the aromatic extraction zone 140 for extraction of a hydrogen-lean fraction and a hydrogen-rich fraction. Optionally, the feedstock can be combined with all or a portion of the bottoms 174 from fractionating zone 170 via recycle conduit 120.

The hydrogen-lean fraction 104 generally includes a major proportion of the aromatic nitrogen- and sulfur-containing compounds that were in the initial feedstock and a minor proportion of non-aromatic compounds that were in the initial feedstock. Aromatic nitrogen-containing compounds that are extracted into the hydrogen-lean fraction include pyrrole, quinoline, acridine, carbazole, and their derivatives. Aromatic sulfur-containing compounds that are extracted into the hydrogen-lean fraction include thiophene, benzothiophene and its long chain alkylated derivatives, and dibenzothiophene and its alkyl derivatives such as 4,6-dimethyl-dibenzothiophene. The hydrogen-rich fraction generally includes a major proportion of the non-aromatic compounds that were in the initial feedstock and a minor proportion of the aromatic nitrogen- and sulfur-containing compounds that were in the initial feedstock. The hydrogen-rich fraction is almost free of the refractory nitrogen-containing compounds, and the hydrogen-lean fraction contains nitrogen-containing aromatic compounds.

The hydrogen-lean fraction discharged via outlet 104 is passed to inlet 151 of first stage hydrocracking reaction zone 150 and mixed with hydrogen gas via conduit 152. Optionally, the hydrogen-lean fraction is combined with all or a portion of the bottoms 174 from the fractionating zone 170 via recycle conduit 156. Compounds contained in the hydrogen-lean fraction, including aromatic compounds are hydrotreated and/or hydrocracked. The first stage hydrocracking reaction zone 150 is operated under relatively severe conditions. In certain embodiments, the operating conditions in the first stage hydrocracking reaction zone 150 are relatively more severe than conventionally known severe hydrocracking conditions due to the comparatively higher concentration of aromatic nitrogen- and sulfur-containing compounds. However, the capital equipment and operational costs of these more severe conditions are offset by the reduced volume of hydrogen-lean feed processed in the first stage hydrocracking reaction zone 150 as compared to a full range feed that would be processed in a conventionally severe hydrocracking unit operation of the prior art.

The hydrocracking reaction zone liquid effluent discharged after gas-liquid separation (not shown) via outlet 154 is mixed with the hydrogen-rich fraction discharged via outlet 106 and passed to inlet 161 of the steam pyrolysis reaction zone 160. Compounds contained in the mixture of the hydrocracking reaction zone effluent and the hydrogen-rich fraction, including paraffins and naphthenes, are cracked. Optionally, the mixture is combined with recycled bottoms from the fractionating zone 170 introduced via conduit 166, with the flow controlled by three-way valves.

The steam pyrolysis reaction zone effluent is sent to one or more intermediate separator vessels (not shown) to remove and recover gases including excess $H_2$, $H_2S$, $NH_3$, methane, ethane, ethylene, propane, propylene, butanes and butylenes. The liquid effluents are passed to inlet 171 of the fractionating zone 170 for recovery of liquid products via outlet 172, including, for instance, naphtha boiling in the nominal range of from about 36° C. to 180° C. and diesel boiling in the nominal range of from about 180° C. to 370° C. The bottoms stream discharged via outlet 174 includes unconverted hydrocarbons and/or partially cracked hydrocarbons, for instance, having a boiling temperature above about 370° C. It is to be understood that the product cut points between fractions are representative only and in practice cut points are selected based on fractionator design characteristics and the composition of a particular feedstock. For instance, the values of the cut points can vary by up to about 30° C. in the embodiments described herein. In addition, it is to be understood that while the integrated system is shown and described with one fractionating zone 170, in certain embodiments separate fractionating zones can be effectively employed.

All or a portion of the bottoms can be purged via conduit 175, e.g., for processing in other unit operations or refineries. In certain embodiments, in order to maximize yields and conversions, a portion of bottoms 174 is recycled within the process to the aromatic separation unit 140, the first stage hydrocracking reaction zone 150, illustratively represented by dashed-lines 120, 156 and 166, respectively, the disposition being controlled by three-way valves 177, 167 and 157.

Figure 4:
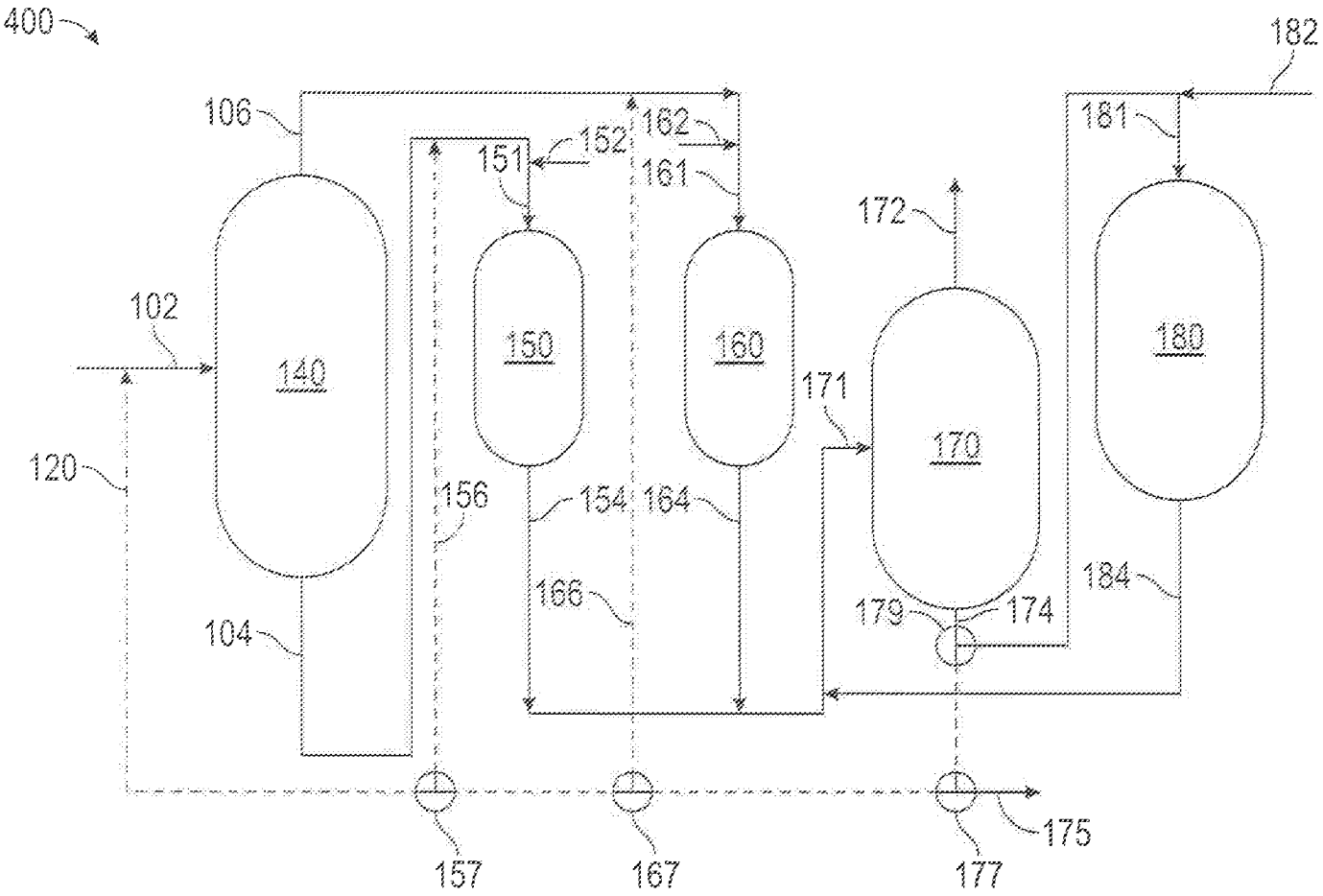
FIG. 4 is a simplified schematic flow diagram of an embodiment of a selective two-stage hydrocracking system suitable for practicing the process of the disclosure.

With reference to FIG. 4, a process flow diagram illustrates an integrated hydrocracking apparatus 400 in the configuration of a two-stage hydrocracking unit apparatus and system. System 400 includes an aromatic extraction zone 140, a first vessel 150 of a first stage hydrocracking reaction zone containing a first stage hydrocracking catalyst, a steam pyrolysis vessel 160, a second stage hydrocracking reaction zone 180 containing a second stage hydrocracking catalyst and a fractionating zone 170.

Aromatic extraction zone 140 includes a feed inlet 102, a hydrogen-lean stream outlet 104 and a hydrogen-rich stream outlet 106. In certain embodiments, feed inlet 102 is in fluid communication with fractionating zone 170 via an optional recycle conduit 120 to receive all or a portion of the bottoms 174. Various embodiments of and/or unit-operations contained within aromatic separation zone 140 are employed in accordance with the prior art based on the characteristics of the aromatics present in the initial feedstock.

First vessel 150 of the first stage hydrocracking reaction zone generally includes an inlet 151 in fluid communication with hydrogen-lean stream outlet 104 and a source of hydrogen gas introduced via a conduit 152. First vessel 150 of the first stage hydrocracking reaction zone also includes a first vessel first stage hydrocracking reaction zone effluent outlet 154. In certain embodiments, inlet 151 is in fluid communication with fractionating zone 170 via an optional recycle conduit 156 to receive all or a portion of the bottoms 174.

First vessel 150 of first stage hydrocracking reaction zone is operated under severe conditions. As used herein, the "severe conditions" are relative and the ranges of operating conditions depend on the feedstock being processed. In certain embodiments of the process described herein, these conditions include a reaction temperature in the range of from about 300° C. to 500° C., and in certain embodiments from about 380° C. to 450° C.; a reaction pressure in the range of from about 100 bars to 200 bars, and in certain embodiments from about 130 bars to 180 bars; a hydrogen feed rate below about 2,500 standard liters per liter of hydrocarbon feed (SLt/Lt), and in certain embodiments from about 500 to 2,500 SLt/Lt, and in further embodiments from about 1,000 to 1,500 SLt/Lt; and a feed rate in the range of from about 0.25 $h^{-1}$ to 3.0 $h^{-1}$, and in certain embodiments from about 0.5 $h^{-1}$ to 1.0 $h^{-1}$.

The catalyst used in the first vessel 150 has one or more active metal components selected from IUPAC Groups 6-10 of the Periodic Table of the Elements. In certain embodiments the active metal component is one or more of cobalt, nickel, tungsten and molybdenum, typically deposited or otherwise incorporated on a support, e.g., alumina, silica-alumina, silica, or zeolites.

Steam pyrolysis vessel 160 includes an inlet 161 in fluid communication with hydrogen-rich stream outlet 106 and steam introduced via a conduit 162. Steam pyrolysis vessel 160 includes steam cracked hydrocarbon reaction zone effluent outlet 164 that is in fluid communication with inlet 171 of the fractionating zone 170.

Steam pyrolysis reaction zone 160 can be operated at a temperature in the broad range of from 400° C. to 900° C., but a preferred operating range is between 800° C. to 900° C. in the convection section and in the pyrolysis section; a pressure in the convection section in the range of 1 bar to 3 bars, and a pressure in the pyrolysis section in the range of 1 bar to 3 bars; a steam-to-hydrocarbon ratio in the convection section in the range of 0.3:1 to 2:1; and a residence time in the convection section and in the pyrolysis section in the range of from 0.05 seconds to 2 seconds.

Fractionating zone 170 includes an inlet 171 in fluid communication with first stage hydrocracking reaction zone effluent outlet 154 and steam pyrolysis reaction zone effluent outlet 164. Fractionating zone 170 also includes a product stream outlet 172 and a bottoms stream outlet 174. As was described above, fractionating zone 170 advantageously comprises a plurality of fractionators for receiving and efficiently separating the hydrocracked and hydrotreated streams.

Second stage hydrocracking reaction zone 180 includes an inlet 181 in fluid communication with fractionating zone bottoms stream outlet 174 and a source of hydrogen gas introduced via a conduit 182. Second stage hydrocracking reaction zone 180 also includes a second stage hydrocracking reaction zone effluent outlet 184 that is in fluid communication with inlet 171 of the fractionating zone 170. Note that while one product outlet 172 is shown, multiple product fractions can also be recovered from fractionating zone 170.

Second stage hydrocracking reaction zone 180 is operated under mild conditions. As used herein, it will be understood that the "mild conditions" are relative and the range of operating conditions depend on the feedstock being processed. In certain embodiments of the process described herein, these conditions include a reaction temperature in the range of from about 300° C. to 500° C., and in certain embodiments from about 330° C. to 420° C.; a reaction pressure in the range of from about 30 bars to 130 bars, and in certain embodiments from about 60 bars to 100 bars; a hydrogen feed rate below 2,500 SLt/Lt, and in certain embodiments from about 500 to 2,500 SLt/Lt, and in further embodiments from about 1,000 to 1,500 SLt/Lt; and a feed rate in the range of from about 1.0 $h^{-1}$ to 5.0 $h^{-1}$, and in certain embodiments from about 2.0 $h^{-1}$ to 3.0 $h^{-1}$.

The catalyst used in the second stage hydrocracking reaction zone has one or more active metal components selected from IUPAC Groups 6-10 of the Periodic Table of the Elements. In certain embodiments the active metal component is one or more of cobalt, nickel, tungsten and molybdenum, typically deposited or otherwise incorporated on a support, e.g., alumina, silica-alumina, silica, or zeolites.

A hydrocarbon feedstock is introduced via inlet 102 of the aromatic extraction zone 140 for extraction of a hydrogen-lean fraction and a hydrogen-rich fraction. Optionally, the feedstock can be combined with all or a portion of the bottoms 174 from fractionating zone 170 via recycle conduit 120.

The hydrogen-lean fraction generally includes a major proportion of the aromatic nitrogen- and sulfur-containing compounds that were in the initial feedstock and a minor proportion of non-aromatic compounds that were in the initial feedstock. Aromatic nitrogen-containing compounds that are extracted into the hydrogen-lean fraction include pyrrole, quinoline, acridine, carbazole, and their derivatives. Aromatic sulfur-containing compounds that are extracted into the hydrogen-lean fraction include thiophene, benzothiophene and its long chain alkylated derivatives, and dibenzothiophene and its alkyl derivatives such as 4,6-dimethyldibenzothiophene. The hydrogen-rich fraction generally includes a major proportion of the non-aromatic compounds that were in the initial feedstock and a minor proportion of the aromatic nitrogen- and sulfur-containing compounds that were in the initial feedstock. The hydrogen-rich fraction is almost free of refractory nitrogen-containing compounds, and the hydrogen-lean fraction contains nitrogen-containing aromatic compounds.

The hydrogen-lean fraction discharged via outlet 104 is passed to inlet 151 of first vessel 150 of first stage hydrocracking reaction zone and mixed with hydrogen gas via conduit 152. Optionally, the hydrogen-lean fraction is combined with all or a portion of the bottoms 174 from fractionating zone 170 via recycle conduit 156. Compounds contained in the hydrogen-lean fraction, including aromatic compounds, are hydrotreated and/or hydrocracked. The first vessel 150 of the first stage hydrocracking reaction zone is operated under relatively severe conditions. In certain embodiments, these relatively severe conditions of the first vessel 150 are relatively more severe than conventional severe hydrocracking conditions due to the comparatively higher concentration of aromatic nitrogen- and sulfur-containing compounds. However, the capital and operational costs of these more severe conditions are offset by the reduced volume of hydrogen-lean feed processed in the first vessel 150 as compared to a full range feed that would be processed in a conventionally known severe hydrocracking unit operation.

The hydrogen-rich fraction discharged via outlet 106 is passed to inlet 161 of the steam pyrolysis vessel 160 and mixed with steam introduced via conduit 162. Compounds contained in the hydrogen-rich fraction that include paraffins and naphthenes are cracked.

The first vessel first stage hydrocracking reaction zone effluent 154 and the steam pyrolysis reaction zone effluent 164 are sent to one or more intermediate separator vessels (not shown) to remove gases including excess $H_2$, $H_2S$, $NH_3$, methane, ethane, ethylene, propane, propylene, butanes and butylenes. The liquid effluents are passed to inlet 171 of the fractionating zone 170 for recovery of liquid products via outlet 172, including, for instance, naphtha boiling in the nominal range of from about 36° C. to 180° C. and diesel boiling in the nominal range of from about 180° C. to 370° C. It is to be understood that the product cut points between fractions are representative only and in practice cut points are selected based on design characteristics and considerations for a particular feedstock. For instance, the values of the cut points can vary by up to about 30° ° C. in the embodiments described herein. In addition, it is to be understood that while the integrated system is shown and described with one fractionating zone 170, in certain embodiments separate fractionating zones can be effective in recovering product streams having a narrow range of characteristics.

All or a portion of the fractionator bottoms 174 can be purged via conduit 175, e.g., for processing in other unit operations or refineries. In certain embodiments in order to maximize yields and conversions a portion of bottoms 174 is recycled within the process to the aromatic separation unit 140 and/or the first vessel 150 of first stage hydrocracking reaction zone 150, and/or to steam pyrolysis vessel 160 (represented by dashed-lines 120, 156 and 166, respectively).

All or a portion of fractionating zone bottoms stream discharged via conduit 174 is mixed with hydrogen gas via inlet 182 and passed to inlet 181 of the second stage hydrocracking reaction zone 180. The second stage hydrocracking reaction zone effluent is discharged via outlet 184 and processed in the fractionating zone 170.

The second stage hydrocracking reaction zone 180 is operated under relatively mild conditions, which can be milder than conventional mild hydrocracking conditions due to the comparatively lower concentration of aromatic nitrogen- and sulfur-containing compounds thereby reducing capital and operational costs.

Figure 5:
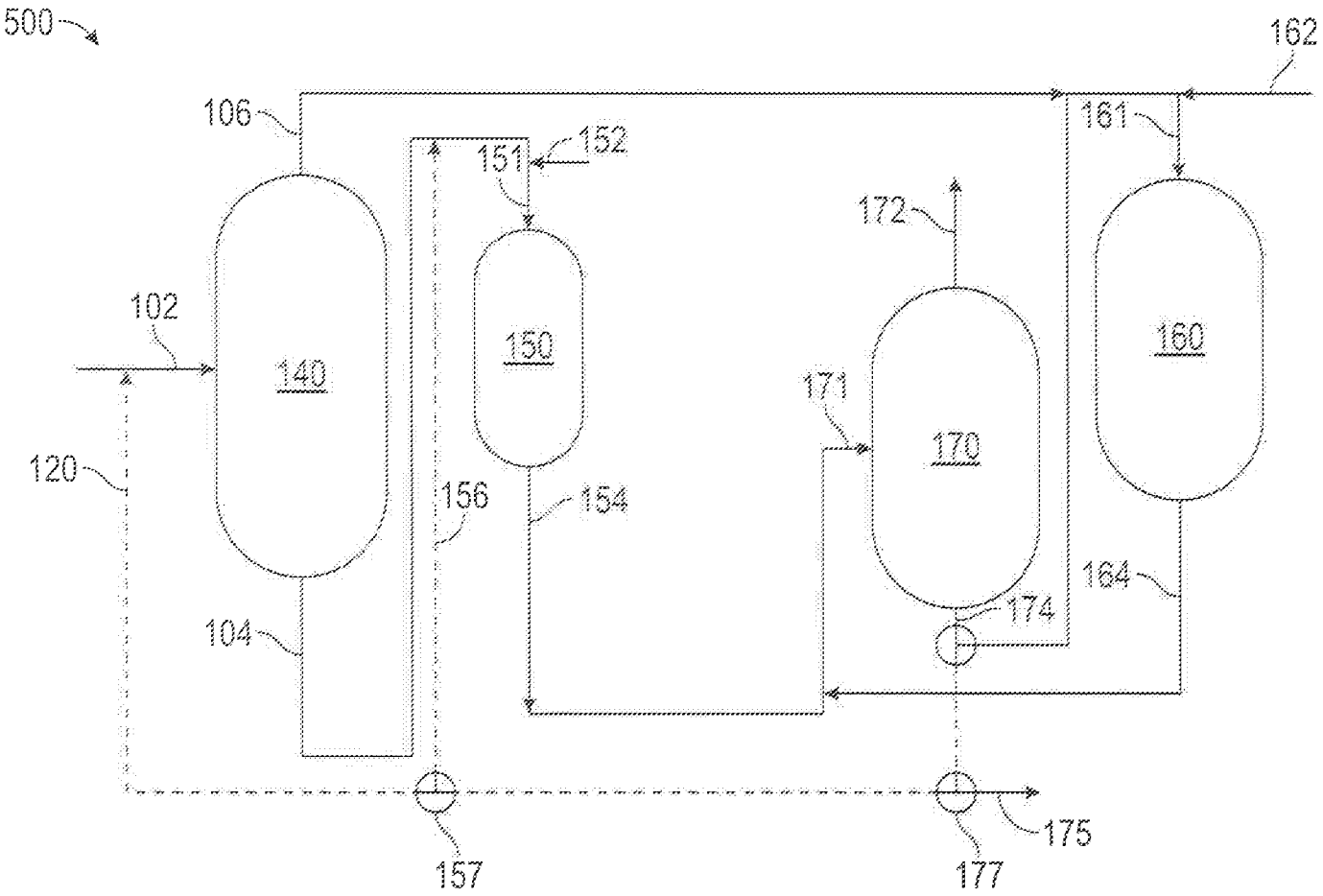
FIG. 5 is a simplified schematic flow diagram of another embodiment of a selective two-stage hydrocracking system suitable for practicing the process of the disclosure

Referring now to the a process flow diagram of FIG. 5, an integrated hydrocracking apparatus and system 500 is shown in the configuration of a two-stage hydrocracking/steam pyrolysis unit system. System 500 includes an aromatics extraction zone 140, a first stage hydrocracking reaction zone 150 containing a first stage hydrocracking catalyst, a steam pyrolysis reaction zone 160 and a fractionating zone 170.

Aromatic extraction zone 140 includes a feed inlet 102, a hydrogen-lean stream outlet 104 and a hydrogen-rich stream outlet 106. In certain embodiments, feed inlet 102 is in fluid communication with fractionating zone 170 via an optional recycle conduit 120 to receive all or a portion of the bottoms stream 174. Various prior art embodiments and unit-operations contained in aromatic extraction zone 140 can be employed and their selection is within the skill of the art and is based upon, inter alia, the characteristics of the aromatics in the initial feed.

First stage hydrocracking reaction zone 150 includes an inlet 151 in fluid communication with hydrogen-lean stream outlet 104, a source of hydrogen gas introduced via a conduit 152, and a first stage hydrocracking reaction zone effluent outlet 154. In certain embodiments, inlet 151 is in fluid communication with fractionating zone 170 via an optional recycle conduit 156 to receive all or a portion of the bottoms 174, with flow controlled by intermediate three-way valves as described above.

First stage hydrocracking reaction zone 150 is operated under severe conditions. As used herein, the "severe conditions" are relative and the ranges of operating conditions depend on the feedstock being processed. In certain embodiments of the process described herein, these conditions include a reaction temperature in the range of from about 300° C. to 500° C., and in certain embodiments from about 380° C. to 450° C.; a reaction pressure in the range of from about 100 bars to 200 bars, and in certain embodiments from about 130 bars to 180 bars; a hydrogen feed rate not exceeding about 2,500 standard liters per liter of hydrocarbon feed (SLt/Lt), and in certain embodiments from about 500 to 2,500 SLt/Lt, and in further embodiments 1,000 to 1,500 SLt/Lt; and a feed rate in the range of from about 025 $h^{-1}$ to 3.0 $h^{-1}$, and in certain embodiments from about 0.5 $h^{-1}$ to 1.0 $h^{-1}$.

The catalyst used in the first stage hydrocracking reaction zone has one or more active metal components selected from IUPAC Groups 6-10 of the Periodic Table of the Elements. In certain embodiments the active metal component is one or more of cobalt, nickel, tungsten and molybdenum, typically deposited or otherwise incorporated on a support, e.g., alumina, silica-alumina, silica, or zeolites.

Fractionating zone 170 includes an inlet 171 in fluid communication with first stage hydrocracking reaction zone effluent outlet 154 and second stage hydrocracking reaction zone effluent outlet 184, a product stream outlet 172 and a bottoms stream outlet 174. Note that while one product outlet is shown for convenience, in practice multiple product fractions will be recovered from multiple fractionators operating in fractionating zone 170.

Steam pyrolysis reaction zone 160 includes an inlet 161 in fluid communication with hydrogen-rich stream outlet 106, fractionating zone bottoms stream outlet 174, and steam via a conduit 162. Steam pyrolysis reaction zone 160 also includes a steam pyrolysis reaction zone effluent outlet 164 that is in fluid communication with inlet 171 of the fractionating zone 170.

A hydrocarbon feedstock is introduced via inlet 102 of the aromatic extraction zone 140 for extraction of a hydrogen-lean fraction and a hydrogen-rich fraction. Optionally, the feedstock can be combined with all or a portion of the bottoms 174 from fractionating zone 170 via recycle conduit 120, the flow of which is controlled by three-way valves 177 and 157.

The hydrogen-lean fraction generally includes a major proportion of the aromatic nitrogen- and sulfur-containing compounds that were in the initial feedstock and a minor proportion of non-aromatic compounds that were in the initial feedstock. Aromatic nitrogen-containing compounds that are extracted into the hydrogen-lean fraction include pyrrole, quinoline, acridine, carbazole, and their derivatives. Aromatic sulfur-containing compounds that are extracted into the hydrogen-lean fraction include thiophene, benzothiophene and its long chain alkylated derivatives, and dibenzothiophene and its alkyl derivatives such as 4,6-dimethyldibenzothiophene. The hydrogen-rich fraction generally includes a major proportion of the non-aromatic compounds that were initially in the feedstock and a minor proportion of the aromatic nitrogen- and sulfur-containing compounds that initially were in the feedstock. The hydrogen-rich fraction is almost free of refractory nitrogen-containing compounds, and the hydrogen-lean fraction contains nitrogen-containing aromatic compounds.

The first stage hydrocracking reaction zone 150 is operated under relatively severe conditions. In certain embodiments, these relatively severe conditions of the first stage 150 are more severe than conventional severe hydrocracking conditions due to the comparatively higher concentration of aromatic nitrogen- and sulfur-containing compounds. However, the capital equipment and operational costs of these more severe conditions are offset by the reduced volume of hydrogen-lean feed processed in the first stage 150 as compared to a full range feed that would be processed in a conventional severe hydrocracking unit operation of the prior art.

The hydrogen-lean fraction discharged via outlet 104 is passed to inlet 151 of the first stage hydrocracking reaction zone 150 and mixed with hydrogen gas introduced via conduit 152. Optionally, the hydrogen-lean fraction is combined with all or a portion of the bottoms 174 from fractionating zone 170 via recycle conduit 156. Compounds contained in the hydrogen-lean fraction including aromatic compounds are hydrotreated and/or hydrocracked.

The first stage hydrocracking reaction zone effluent is sent to one or more intermediate separator vessels (not shown) to remove gases including excess $H_2$, $H_2S$, $NH_3$, methane, ethane, propane and butanes. The liquid effluents are passed to inlet 171 of the fractionating zone 170 for recovery of gas and liquid products via outlet 172, including, for instance, naphtha nominally boiling in the range of from about 36° C. to 180° C. and diesel nominally boiling in the range of from about 180° C. to 370° C. The bottoms stream discharged via outlet 174 includes unconverted hydrocarbons and/or partially cracked hydrocarbons, for instance, having a boiling temperature above about 370° C. It is to be understood that the product cut points between fractions are representative only and in practice cut points are selected based on fractionator design parameters and the characteristics of particular feedstocks. For instance, the values of the cut points can vary by up to about 30° C. in the embodiments described herein. In addition, it is to be understood that while the integrated system is shown and described with one fractionating zone 170, in certain embodiments separate fractionating zones can be effectively employed to enhance the recovery of specific fractions.

All or a portion of the bottoms can be purged via conduit 175, e.g., for processing in other unit operations or refineries. In certain embodiments, in order to maximize yields and conversions a portion of bottoms 174 is recycled to the aromatic extraction zone 140 and/or the first stage hydrocracking reaction zone 150, as represented by dashed-lines 120 and 156, respectively.

A mixture of all or a portion of fractionating zone bottoms stream discharged via conduit 174, hydrogen-rich fraction discharged via outlet 106 and steam introduced via conduit 162 is passed to inlet 161 of the steam pyrolysis reaction zone 160. The steam pyrolysis reaction zone effluent is discharged via outlet 164 and processed in fractionating zone 170. Compounds contained in the mixture of the first stage hydrocracking reaction zone bottoms and the hydrogen-rich fraction, including paraffins and naphthenes, are hydrotreated and/or hydrocracked. The steam cracking reaction zone 160 can be operated at a temperature in the broad range of from 400° C. to 900° C., but a preferred operating range is between 800° C. to 900° C. in the convection section and in the pyrolysis section; a steam-to-hydrocarbon ratio in the convection section in the range of 0.3:1 to 2:1; and a residence time in the convection section and in the pyrolysis section in the range of from 0.05 seconds to 2 seconds.

In addition, either or both of the hydrogen-rich fraction and the hydrogen-lean fraction also can include extraction solvent that remains from the aromatic extraction zone 140. In certain embodiments, extraction solvent can be recovered as product via fractionator outlet 172 and recycled.

In the above-described embodiment, a suitable feedstock can include any liquid hydrocarbon feed that is conventionally recognized by those of ordinary skill in the art as being suitable for hydrocracking operations. For instance, a typical hydrocracking feedstock is vacuum gas oil (VGO) boiling in the nominal range of from about 300° C. to 900° C. and in certain embodiments in the range of from about 370° C. to 520° C. De-metalized oil (DMO) or de-asphalted oil (DAO) can be blended with VGO or used alone. The hydrocarbon feedstocks can be derived from naturally occurring fossil fuels such as crude oil, shale oils or coal liquids; or from intermediate refinery products or their distillation fractions such as naphtha, gas oil, coker liquids, fluid catalytic cracking cycle oils, residuals, or combinations of any of the aforementioned sources. In general, aromatics content in VGO feedstock is in the range of from about 15 to 60 volume % (V %). The recycle stream can include 0 W % to about 80 W % of stream 174, and in certain embodiments about 10 W % to 70 W % of stream 174, and in further embodiments about 20 W % to 60 W % of stream 174, for instance, based on conversions in each zone of between about 10 W % and 80 W %.

The aromatic separation apparatus can be based on selective aromatic extraction. For instance, the aromatic separation apparatus can be a suitable aromatic solvent extraction separation apparatus capable of partitioning the feed into a generally hydrogen-rich stream and a generally hydrogen-lean stream. Systems including various established aromatic extraction processes and unit operations used in other stages of various refinery and other petroleum-related operations can advantageously be employed as the aromatic separation apparatus in the present process. In certain existing processes, it is desirable to remove aromatics from the end product, e.g., lube oils and certain fuels, e.g., diesel fuel. In other processes, aromatics are extracted to produce hydrogen-lean products, for instance, for use in various chemical processes and as an octane booster for gasoline.

The processes and systems of the present invention have been described in detail above and in the attached schematic illustrations, and by the examples. Various modifications will be apparent to those of ordinary skill in the art from this description and the scope of protection for the invention is to be determined by the claims that follow.

The invention claimed is:

1. An integrated hydrocracking and steam pyrolysis process for producing cracked hydrocarbons from a hydrocarbon feed that contains aromatic, paraffinic and olefinic compounds, the process comprising:

a. introducing the hydrocarbon feed into an aromatic separation zone, and recovering from the aromatic separation zone an aromatic-rich fraction and an aromatic-lean fraction;

b. hydrocracking the aromatic-rich fraction in a hydrocracking reaction zone at a reaction temperature in the range of from 300° C. to 500° C., a reaction pressure in the range of from 130 bars to 200 bars, a hydrogen feed rate of up to 2500 standard liters per liter of hydrocarbon feed (SLt/Lt), and a feed rate in the range of from 0.25 $h^{-1}$ to 3.0 $h^{-1}$ to produce a hydrocracking reaction zone effluent;

c. subjecting the aromatic-lean fraction to cracking by steam pyrolysis in a steam pyrolysis reaction zone operated at a temperature in the range of from 400° C. to 900° C. in the convection section and in the pyrolysis section, a pressure in the convection section in the range of 1 bar to 3 bars, and a pressure in the pyrolysis section in the range of 1 bar to 3 bars, a steam-to-hydrocarbon ratio in the convection section in the range of 0.3:1 to 2:1, and a combined residence time in the convection section and the pyrolysis section in the range of from 0.05 seconds to 2 seconds, to produce cracked steam pyrolysis reaction zone effluents that include light olefins, gases and pyrolysis oil; and d. fractionating, in a fractionation zone, the hydrocracking reaction zone effluent and the steam pyrolysis reaction zone effluents to produce one or more product streams and one or more bottoms streams.

2. The process of claim 1, wherein all or a portion of the one or more fractionating zone bottoms streams are selectively passed to one or more of the steam pyrolysis reaction zone, the hydrocracking reaction zone and the aromatic extraction zone for further processing.

3. The process of claim 1, wherein the hydrocracking reaction zone is operated under relatively severe conditions effective to remove heteroatoms from, and to hydrocrack, at least a portion of the aromatic compounds contained in the aromatic-rich fraction.

4. The process of claim 1, wherein the aromatic-rich fraction includes nitrogen-containing aromatic compounds including pyrrole, quinoline, acridine, carbazole, and their derivatives.

5. The process of claim 1, wherein the aromatic-rich fraction includes aromatic sulfur compounds including thiophene, benzothiophenes and their derivatives, and dibenzothiophenes and their derivatives.

6. The process of claim 1, wherein separating the hydrocarbon feed into an aromatic-lean fraction and an aromatic-rich fraction comprises:

passing the hydrocarbon feed and an effective quantity of extraction solvent to the extraction zone and recovering a solvent extract containing a major proportion of the aromatic content of the hydrocarbon feed and a portion of the extraction solvent and a raffinate containing a major proportion of the non-aromatic content of the hydrocarbon feed and a portion of the extraction is solvent;

separating at least a substantial portion of the extraction solvent from the raffinate and retaining the aromatic-lean fraction; and separating at least a substantial portion of the extraction solvent from the solvent extract and retaining the aromatic-rich fraction.

7. The process of claim 1 in which the steam pyrolysis reaction zone is operated at a temperature in the range of from 825° C. to 875° C. in the convection section and in the pyrolysis section, a steam-to-hydrocarbon ratio in the convection section in the range of 0.3:1 to 2:1; a pressure of 1 to 2 bar in the pyrolysis section; and a residence time in the convection section and in the pyrolysis section in the range of from 0.05 seconds to 2 seconds.

* * * * *